United States Patent [19]

Riedl

[11] 4,420,382

[45] Dec. 13, 1983

[54] METHOD FOR CONTROLLING END EFFECT ON ANODES USED FOR CATHODIC PROTECTION AND OTHER APPLICATIONS

[75] Inventor: George Riedl, Pierrefonds, Canada

[73] Assignee: Alcan International Limited, Montreal, Canada

[21] Appl. No.: 224,803

[22] Filed: Jan. 13, 1981

[30] Foreign Application Priority Data

Jan. 18, 1980 [GB] United Kingdom ..... 8001783

[51] Int. Cl.[3] ..... C23F 13/00

[52] U.S. Cl. ..... 204/147; 204/148; 204/196; 204/197; 204/DIG. 7

[58] Field of Search ..... 204/147, 148, 196, 197, 204/DIG. 7

[56] References Cited

U.S. PATENT DOCUMENTS

| | | | |
|---|---|---|---|
| 644,029 | 2/1900 | Cowper-Coles | 204/DIG. 7 |
| 1,506,306 | 8/1924 | Kirkaldy | 204/196 |
| 2,329,961 | 9/1943 | Walker | 204/196 |
| 2,721,172 | 10/1955 | Higgins et al. | 204/197 |
| 2,934,485 | 4/1960 | Sabins | 204/197 |
| 3,182,007 | 5/1965 | Hutchison et al. | 204/196 |
| 3,471,395 | 10/1969 | Sumner | 204/196 |
| 3,513,082 | 5/1970 | Beer et al. | 204/197 |
| 4,175,021 | 11/1979 | Tatum et al. | 204/196 |
| 4,224,126 | 9/1980 | Bidwell | 204/197 |

*Primary Examiner*—T. Tung

*Attorney, Agent, or Firm*—Cooper, Dunham, Clark, Griffin & Moran

[57] ABSTRACT

'Necking' of elongated cathodic protection anodes is obviated or reduced by means of a nonconductive shield placed around the periphery of the anode, but spaced away from the surface of the anode at the end at which it is connected to a conductor cable. The gap between the shield and the electrode surface is generally in the range of 15–30% of the radius of curvature of the electrode surface.

The shield may extend over, but be spaced away from, the end surface of the electrode also.

10 Claims, 1 Drawing Figure

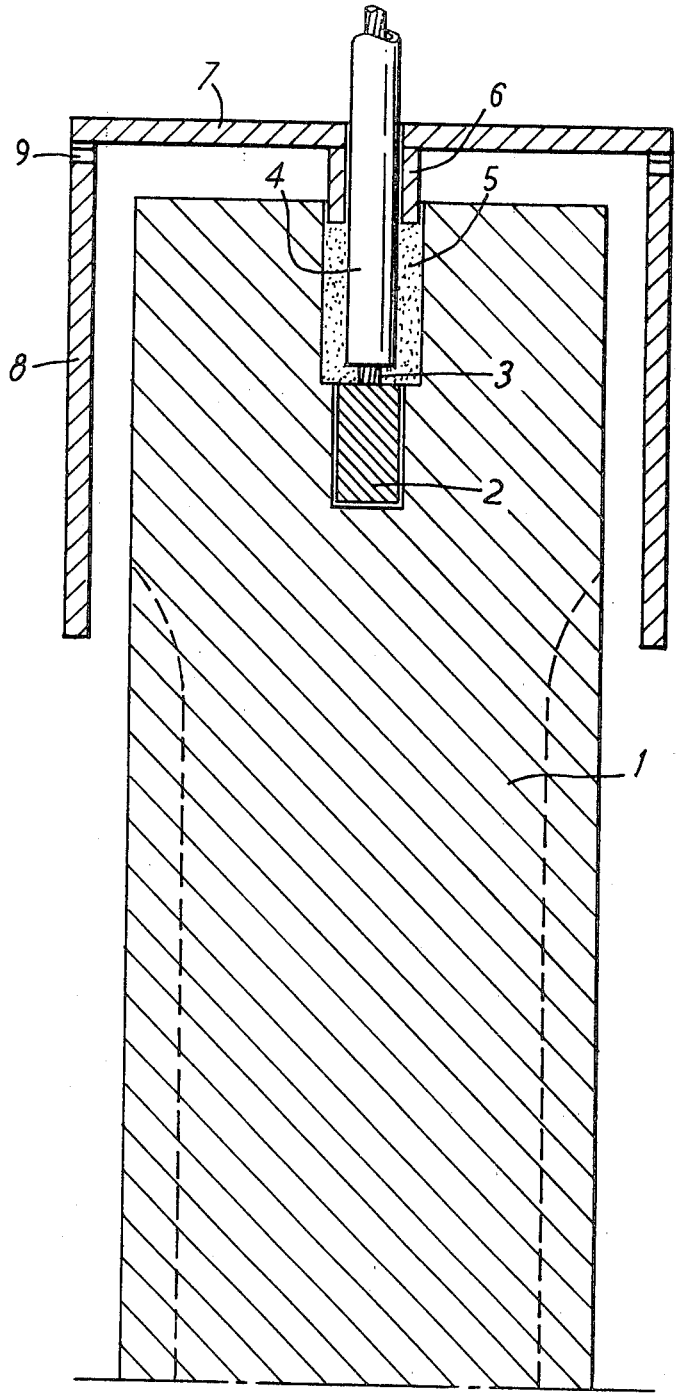
7
6
9
4
5
8
3
2
1

METHOD FOR CONTROLLING END EFFECT ON ANODES USED FOR CATHODIC PROTECTION AND OTHER APPLICATIONS

The present invention relates to improvements in the performance of anodes made of metals, semi-conductors and non-metals.

An anode is an electrode at which oxidation occurs and/or is the electron-emitting electrode. Depending on the application and anode material, the mass of the anode decreases at various rates during its operation, thus affecting the performance and the life of the anode.

Anodes can be used as sacrificial or impressed current anodes for cathodic protection and other industrial processes. All such anodes, both of the sacrificial and of the impressed current type, used in liquid electrolytes are subject to consumption regardless of what material the anode is made from.

In both cathodic protection and plating processes the anode is in many instances completely immersed in the electrolyte and, consequently, the electrical conductor (cable for example) connecting the anode with the cathode, directly or through the current supply unit, is also exposed to the electrolyte. The electrical conductor and the connection between the anode and the electrical conductor must be protected from the chemical and electrochemical effects of the electrolyte.

The present invention is particularly, but not exclusively, directed to anodes (graphite, lead-silver etc.) operating in so-called impressed current cathodic protection systems, where the protected structure is rendered cathodic by connection to one or more anodes through a D.C. power source, both the protected structure and the anode(s) being within a common electrolyte, such as sea water or soil.

The invention is also applicable to so-called sacrificial anodes (aluminium, magnesium, zinc), in which the object to be protected, such as a ship hull or stationary steel structure, forms a cathode which is directly connected to the anode by an electrical conductor. A sacrificial anode is one which has a higher corrosion rate than the metal to which it is connected in the electrolyte in which both are located.

It is a common practice to make the connection between an impressed current anode and an insulated cable or other conductor inside the anode and to seal off the connection with an inert non-conductive material to prevent ingress of the electrolyte. The anode-cable connection may be located a few inches or a few feet away from one end of the anode. In some sacrificial anodes, a smaller diameter steel core provides the connection over the entire length of the anode. Many processes use elongated anodes, usually cylindrical anodes, and in most cases the cable or other conductor usually enters the anode at one end. In cathodic protection, for example, the anodes may be 3 in. to 6 in. in diameter and 30 in. to 80 in. long.

The elongated shape of the anode, which has some theoretical and practical justifications, creates increased concentration and discharge of current at both ends of the anode. The high current density at the ends causes accelerated loss of anode material at these locations due to chemical and/or electrochemical reactions, or due to spalling. The current density is at a maximum in the region of any sharp edge, such as at the junction between a flat end and a cylindrical side surface of an anode.

In general, on cylindrical anodes the activity of the 'end effect' will be lowest when the anode has a radius to length ratio equal to 1:1. As the ratio changes, the activity of the 'end effect' increases at the smaller site.

On cylindrical anodes the 'end effect' will not only occur at the physical ends of the anodes, but also at the edge of any insulating circumferential obstruction around the cylindrical part of the anode. For example, if a tightly fitting plastic ring is installed at the middle of the anode, the single anode will behave like two individual anodes. The 'end effect' will be visible at both edges of the plastic ring. The intensity of the 'end effect' will depend on the length of the plastic ring.

The result of an intensive 'end effect' at the edge of any circumferential obstruction on the surface of the anode is called 'necking'. 'Necking', once triggered, reduces the diameter of the anode within a narrow band with increasing speed. This is because the curvature of the surface is continuously diminishing as the material of the anode is removed and is accompanied by increasing current density which increases the rate of removal. The result of 'necking' is that the anode fails prematurely at this point.

The objective of the present invention is to greatly reduce or eliminate the 'end effect' and the 'necking'. This can be achieved by installing a circumferential insulating obstruction spaced at a small, but substantial, distance from the surface of the anode at the area or areas where high current density occurs.

Because of the space between the circumferential obstruction and the anode, the current density discharged from the surface of the anode diminishes gradually as the anode disappears inside of the obstruction. The reduction of current output is caused by the fact that the surface of the anode is prevented from discharging in the direction of the cathode.

The shield may be cylindrical or bell-shaped, and have any cross section required to correspond to the shape of the anode. It may be open or closed at one end, with or without openings for release of gases and/or for circulation of electrolyte. The space between the anode surface and the shield is substantial although small in relation to the radius of curvature of the adjacent surface of the anode. The space between the shield and the anode is preferably somewhat proportionate to the diameter of a cylindrical anode. Conveniently it may be 0.3 cm. for anodes of 2.5 cm. diameter, 0.3 cm. to 1.0 cm. for anodes of 2.5 cm. to 10 cm. diameter and 1 cm. to 2.5 cm. for larger anodes. Thus it is preferred that the initial gap between the shield and the adjacent surface of the anode is 15–30% of the radius of curvature of the anode surface.

For elongated anodes having a length of at least 12 times the diameter and having an anode-cable connector installed in one end of the anode, the axial length of the shield should be approximately equal to the diameter of the anode. In any case, the lower end of the shield should be approximately 2.5–5 cms. below the upper end of the cylindrical surface of a vertically arranged anode.

On short, stubby anodes having a relatively large diameter of 15 cms. or more, the length of the shield may be reduced to approximately one quarter of the anode diameter. Where a connector is located within the anode it is preferred that the lower edge of the shield should extend beyond the end of the connector. It becomes of less importance to have an actual overlap as the diameter of the anode is increased beyond 15 cms.

The shield permits the anode-cable connector to be closer to the end of the anode and thus allows a more complete consumption of the anode. Without the shield the increased consumption of the anode material at the end region frequently results in premature failure of the anode around the connector.

In many cathodic protection applications the use of the shield would not only control the 'end effect' and 'necking' but would also permit the installation of the anode-cable connection close to the end of the anode. This would facilitate machining and assembly.

Referring to the accompanying drawing it will be seen that an impressed current anode consists of a solid cylinder 1 of anode material, such as graphite, lead-silver or aluminium. A metal connector 2 connects the anode to a conductor cable 3, the insulation 4 of the cable being embedded in sealant 5. The protector shield is in the form of a plastic moulding, having a shield holder 6, a cover 7 and a cylindrical shield 8. The shield is formed with vents 9 for escape of gas.

The interrupted lines on the anode indicate the approximate future shape of the anode on discharge of current.

Extensive laboratory tests in liquid electrolytes were conducted using graphite, aluminium and magnesium anodes. The aluminium and magnesium anodes are operated either as sacrificial anodes or parallel with graphite as impressed current anodes at low and at very high current densities. In all modes of operation accelerated corrosion at the protected location was avoided and the service life of the anode was consequently extended.

Tests were conducted to prove that the shield will perform equally well on any size of anode. The tests confirmed the effectiveness and performance of the shield installed on all types of anodes but particularly on the impressed current anodes discharging large amount of current.

I claim:

1. A method of improving the performance of a generally cylindrical anode having an insulated conductor electrically connected at one end thereof and being located within a surrounding body of corrosive medium which comprises placing a shield formed of electrically non-conducting material in said medium and around a minor portion of the length of the cylindrical surface of the anode and around said insulated conductor at said one end of said anode, said shield being spaced away from said cylindrical surface by a substantial distance which is small in relation to the radius of curvature of said cylindrical surface.

2. A method according to claim 1 in which the initial gap between the surface of the shield and the adjacent cylindrical surface of the anode is 15–30% of the radius of curvature of the anode.

3. A method according to claim 1 wherein said shield of electrically nonconducting material has an end portion facing the end surface of said electrode adjacent said cylindrical surface, said shield being spaced away from said end surface to permit access of said corrosive medium thereto.

4. A method according to claim 3 further comprising providing at least one gas escape passage for release of gas generated within the gap between said shield and the adjacent cylindrical surface of the anode.

5. An anode assembly comprising an elongated body of electrically conductive material, an insulated conductor electrically connected to said body internally thereof and extending substantially axially out of one end of said body, a cup-shaped nonconducting shield member having an end portion surrounding said insulated conductor and spaced away from the adjacent surface of said body and a generally cylindrical wall portion extending around but spaced away from the adjacent peripheral surface of said elongated body at said one end thereof, said end portion and said cylindrical wall portion being arranged to permit unrestrained access of liquid to the surfaces of said body facing said end portion and said cylindrical wall portion, said body projecting beyond said cylindrical wall portion.

6. An anode assembly according to claim 5 wherein said end portion of said shield member is flat, facing the end surface of said body.

7. An anode assembly according to claim 6 in which one or more gas escape passages are provided in said cylindrical portion adjacent its junction with said flat end portion.

8. An anode assembly according to claim 5 in which the cylindrical portion of said shield member is spaced away from the adjacent surface of said body, for entrance of liquid therebetween, by a distance equal to 15–30 percent of the radius of curvature of said surface.

9. An anode assembly according to claim 5 in which the cylindrical portion of said shield overlaps the peripheral wall of said body by a distance of about 2.5–5 cm.

10. An anode assembly according to claim 5 in which the conductor is connected to the elongated body by means of a connector located axially within said body, the axial length of said cylindrical portion of said shield being sufficient to completely surround said connector.

* * * * *